US007849706B2

(12) United States Patent
Yasutomi et al.

(10) Patent No.: US 7,849,706 B2
(45) Date of Patent: Dec. 14, 2010

(54) INDOOR UNIT OF AN AIR CONDITIONER

(75) Inventors: Masanao Yasutomi, Kusatsu (JP); Seiji Oka, Kusatsu (JP); Mikio Ito, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 379 days.

(21) Appl. No.: 11/630,974

(22) PCT Filed: Jul. 13, 2005

(86) PCT No.: PCT/JP2005/012913

§ 371 (c)(1),
(2), (4) Date: Dec. 28, 2006

(87) PCT Pub. No.: WO2006/006622

PCT Pub. Date: Jan. 19, 2006

(65) Prior Publication Data

US 2008/0016897 A1 Jan. 24, 2008

(30) Foreign Application Priority Data

Jul. 14, 2004 (JP) ..... 2004-206772

(51) Int. Cl.
*F25D 19/00* (2006.01)

(52) U.S. Cl. ..... 62/298; 62/419; 62/409; 62/186; 62/262; 62/263

(58) Field of Classification Search ..... 62/186, 62/409, 419, 262, 263, 298
See application file for complete search history.

(56) References Cited

U.S. PATENT DOCUMENTS 3,354,809 A 11/1967 Orr et al.
4,899,930 A * 2/1990 Kagohata et al. ..... 236/91 F
5,341,650 A 8/1994 Nagasawa et al.
5,385,031 A * 1/1995 Kizawa et al. ..... 62/186
5,600,963 A * 2/1997 Koo et al. ..... 62/262
5,678,417 A * 10/1997 Nigo et al. ..... 62/186
5,850,742 A * 12/1998 Bang et al. ..... 62/89

(Continued)

FOREIGN PATENT DOCUMENTS

EP 1 271 065 A2 1/2003

(Continued)

OTHER PUBLICATIONS

The extended European Search Report of corresponding European Application No. 05765760.3 dated Apr. 19, 2010.

*Primary Examiner*—William E Tapolcai
*Assistant Examiner*—Jonathan Koagel
(74) *Attorney, Agent, or Firm*—Global IP Counselors

(57) ABSTRACT

An indoor unit of an air conditioner includes an indoor unit casing having a first suction port, a panel, a moving mechanism, and a control unit. The panel opens the first suction port by moving so that the panel is spaced apart from the indoor unit casing, and closes the first suction port by moving so that the panel is proximate to the indoor unit casing. The moving mechanism moves the panel so that the first suction port is opened to a desired degree of opening. The control unit controls the moving mechanism. Furthermore, the control unit is capable of modifying the degree of opening of the first suction port to a desired degree of opening.

15 Claims, 10 Drawing Sheets

U.S. PATENT DOCUMENTS

| | | | | |
|---|---|---|---|---|
| 6,244,954 | B1 * | 6/2001 | Hosokawa et al. | 454/315 |
| 6,415,622 | B2 * | 7/2002 | Kim et al. | 62/409 |
| 6,725,684 | B2 * | 4/2004 | Lee et al. | 62/298 |
| 2002/0189274 | A1 * | 12/2002 | Lee et al. | 62/298 |

FOREIGN PATENT DOCUMENTS

| | | | |
|---|---|---|---|
| JP | 04-20923 | U | 2/1992 |
| JP | 07-098129 | A | 4/1995 |
| JP | 2003-74962 | A | 3/2003 |

* cited by examiner 1
2
5
20
23
24
21
62
61
6
G
A1
A2

INDOOR UNIT OF AN AIR CONDITIONER

CROSS-REFERENCE TO RELATED APPLICATIONS

This U.S. National stage application claims priority under 35 U.S.C. §119(a) to Japanese Patent Application No. 2004-206772, filed in Japan on Jul. 14, 2004, the entire contents of which are hereby incorporated herein by reference.

TECHNICAL FIELD

The present invention relates to an indoor unit of an air conditioner.

BACKGROUND ART

It is known to equip an indoor unit of an air conditioner with an opening and closing panel that covers a suction port, which is provided in a casing. This opening and closing panel covers the suction port when the operation of the indoor unit of the air conditioner is stopped, thereby making it possible to conceal the suction port from external view and thereby improve the design qualities of the indoor unit. In addition, the movement of the opening and closing panel so that the suction port opens ensures the intake of air when operating the indoor unit of the air conditioner (refer to Japanese Published Unexamined Patent Application No. H7-98129, FIG. 1). It is thereby possible to simultaneously achieve good design qualities and ventilation performance.

SUMMARY OF THE INVENTION

Problems Solved by the Invention

Nevertheless, there is a problem with the air conditioner of the type discussed above in that the opening and closing panel opens the suction port only by a uniform opening degree, which makes it difficult to ensure an amount of air suction that is appropriate to the operation of the air conditioner. For example, there are cases with air conditioners in recent years wherein, in addition to the normal cooling and heating operation modes, operation is performed by selecting from a plurality of operation modes, such as "power operation," which increases the cooling or heating output when it is desired to rapidly cool or heat an indoor space, and "bedtime operation," which suppresses operating noise when, for example, the room occupants are sleeping. However, if the opening and closing panel opens identically even with such differing operation modes, then there is a risk that operation will not be properly performed in each operation mode. As explained in the example above, because different amounts of air suction are needed for power operation and normal operation, if the opening and closing panel is opened identically for both power operation and normal operation, then there is a risk that the amount of air suction during power operation will be insufficient, thus making it impossible to ensure sufficient performance. Alternatively, if the output of the ventilating or the frequency of the compressor is increased excessively in order to ensure the required ventilation capacity for power operation, then there is a risk that power consumption will increase.

It is an object of the present invention to provide an air conditioner indoor unit that can ensure an amount of air suction that is appropriate to its operation.

Means for Solving the Problems

An indoor unit of an air conditioner according to a first aspect of the invention comprises a casing wherein a suction port is provided, an opening and closing panel, a moving mechanism, and a control unit. The opening and closing panel opens the suction port by moving so that it is spaced apart from the casing, and closes the suction port by moving so that it is proximate to the casing. The moving mechanism moves the opening and closing panel so that the suction port opens to a desired opening degree. The control unit controls the moving mechanism. Furthermore, the control unit is capable of modifying the opening degree of the suction port to a desired opening degree by controlling the moving mechanism.

With the indoor unit of the present air conditioner, the control unit can modify the opening degree of the suction port to a desired opening degree. It is consequently possible to open the suction port to an opening degree that is appropriate to the operation of the air conditioner. It is thereby possible to ensure an amount of air suction appropriate to operation.

An indoor unit of an air conditioner according to a second aspect of the invention is an indoor unit of an air conditioner according to the first aspect of the invention, wherein the control unit is capable of modifying the opening degree of the suction port in a plurality of steps by controlling the moving mechanism.

With the indoor unit of the present air conditioner, the control unit can modify the opening degree of the suction port in a plurality of steps. It is consequently possible to open the suction port to an opening degree that is appropriate to the operation of the air conditioner. It is thereby possible to ensure an amount of air suction appropriate to operation.

An indoor unit of an air conditioner according to a third aspect of the invention is an indoor unit of an air conditioner according to the first aspect of the invention or the second aspect of the invention, further comprising a ventilating apparatus, which is controlled by the control unit. Furthermore, the control unit is capable of modifying the opening degree of the suction port to a desired opening degree in accordance with an air volume produced by the ventilating apparatus.

With the indoor unit of the present air conditioner, it is possible to modify the opening degree of the suction port to a desired opening degree in accordance with the air volume produced by the ventilating apparatus. It is consequently possible to ensure an amount of air suction that is appropriate to the air volume produced by the ventilating apparatus.

An indoor unit of an air conditioner according to a fourth aspect of the invention is an indoor unit of an air conditioner according to the first aspect of the invention or the second aspect of the invention, wherein the control unit is capable of executing an air conditioning operation in one operation mode that is selected from a plurality of operation modes, and opens the suction port to an opening degree that corresponds to the selected operation mode.

With the indoor unit of the present air conditioner, control is performed wherein the suction port is opened to an opening degree corresponding to the selected operation mode. Consequently, the suction port is not opened to the same opening degree regardless of the operation mode, but rather it is possible to open the suction port to an opening degree appropriate to each operation mode. Thereby, with the indoor unit of the present air conditioner, it is possible to perform appropriate operation in each of a plurality of operation modes.

An indoor unit of an air conditioner according to a fifth aspect of the invention is an indoor unit of an air conditioner according to the fourth aspect of the invention, further comprising an instructing apparatus for selecting one operation mode from the plurality of operation modes, and issuing an instruction to the control unit to perform such. Furthermore, the control unit opens the suction port to an opening degree, which corresponds to the operation mode instructed by the instructing apparatus, by controlling the moving mechanism.

With the indoor unit of the present air conditioner, control is performed wherein the suction port is opened to an opening degree corresponding to the operation mode instructed by the instructing apparatus. Consequently, the suction port is not opened to the same opening degree regardless of the operation mode, but rather the suction port can be opened to an opening degree appropriate to each operation mode. Thereby, with the indoor unit of the present air conditioner, it is possible to perform appropriate operation in each of a plurality of operation modes.

An indoor unit of an air conditioner according to a sixth aspect of the invention is an indoor unit of an air conditioner according to the fifth aspect of the invention, further comprising a ventilating apparatus, which is controlled by the control unit. Furthermore, if the control unit is instructed to perform a first operation mode among the plurality of operation modes, then the control unit sets the output of the ventilating apparatus to a first air volume and opens the suction port to a first opening degree by controlling the moving mechanism. In addition, if the control unit is instructed to perform a second operation mode among the plurality of operation modes, then the control unit sets the output of the ventilating apparatus to a second air volume, which is less than the first air volume, and opens the suction port to a second opening degree, which is greater than the first opening degree, by controlling the moving mechanism.

With the indoor unit of the present air conditioner, the output of the ventilating apparatus in the second operation mode is set to the second air volume, which is smaller than the first air volume, and it is thereby possible to suppress operating noise of the ventilating apparatus more than in the first operation mode. In addition, in the second operation mode, the suction port is opened to a second opening degree that is larger than the first opening degree, and it is thereby possible to reduce the loss of air pressure of the suctioned air more than in the first operation mode, as well as to maintain the air conditioning capacity needed for a low air volume. Thereby, with the present air conditioner, it is possible to suppress operating noise, as well as prevent a reduction in air conditioning capacity.

An indoor unit of an air conditioner according to a seventh aspect of the invention is an indoor unit of an air conditioner according to the fifth aspect of the invention, further comprising a ventilating apparatus, which is controlled by the control unit. Furthermore, if the control unit is instructed to perform a first operation mode among the plurality of operation modes, then the control unit sets the output of the ventilating apparatus to a first air volume and opens the suction port to a first opening degree by controlling the moving mechanism. In addition, if the control unit is instructed to perform a third operation mode among the plurality of operation modes, then the control unit sets the output of the ventilating apparatus to the first air volume and opens the suction port to a second opening degree, which is greater than the first opening degree, by controlling the moving mechanism.

With the indoor unit of the present air conditioner, the output of the ventilating apparatus in the third operation mode remains at the first air volume, and the suction port opens to the second opening degree, which is greater than the first opening degree. It is consequently possible to reduce the pressure loss of the suctioned air as well as to suppress the wind noise produced by the suctioned air.

An indoor unit of an air conditioner according to an eighth aspect of the invention is an indoor unit of an air conditioner according to the sixth aspect of the invention or the seventh aspect of the invention, wherein the second opening degree is an opening degree wherein the suction port is maximally open.

With the indoor unit of the present air conditioner, the suction port is opened to its maximum by opening it to the second opening degree. It is consequently possible to further reduce the pressure loss of the suctioned air.

An indoor unit of an air conditioner according to a ninth aspect of the invention is an indoor unit of an air conditioner according to the fifth aspect of the invention, further comprising a ventilating apparatus, which is controlled by the control unit. Furthermore, if the control unit is instructed to perform a first operation mode among the plurality of operation modes, then the control unit sets the output of the ventilating apparatus to a first air volume and opens the suction port to a first opening degree by controlling the moving mechanism. In addition, if the control unit is instructed to perform a fourth operation mode among the plurality of operation modes, then the control unit sets the output of the ventilating apparatus to a third air volume, which is greater than the first air volume, and opens the suction port to a third opening degree, which is greater than the first opening degree, by controlling the moving mechanism.

With the indoor unit of the present air conditioner, the output of the ventilating apparatus in the fourth operation mode is set to the third air volume, which is greater than the first air volume, and the suction port is opened to the third opening degree, which is greater than the first opening degree. It is consequently possible to reduce the pressure loss of the suctioned air as well as to suck in a larger amount of air in accordance with the increase in the output of the ventilating apparatus. It is thereby possible with the present air conditioner to ensure a larger air conditioning capacity.

An indoor unit of an air conditioner according to a tenth aspect of the invention is an indoor unit of an air conditioner according to the ninth aspect of the invention, wherein the third opening degree is an opening degree wherein the suction port is maximally open.

With the indoor unit of the present air conditioner, the suction port is opened to its maximum by opening it to the third opening degree. It is consequently possible to further reduce the pressure loss of the suctioned air as well as to suck in a greater amount of air.

An indoor unit of an air conditioner according to an eleventh aspect of the invention is an indoor unit of an air conditioner according to any one aspect of the first through tenth aspects of the invention, wherein the casing is further provided with a blow out port. In addition, the opening and closing panel comprises a first panel part that opens and closes the blow out port and a second panel part that is formed integrally with the first panel part and opens and closes the suction port; and the opening and closing panel closes the suction port and the blow out port in an operation stopped state.

With the indoor unit of the present air conditioner, the suction port and the blow out port are closed by the integrated opening and closing panel in the operation stopped state. It is consequently possible to make the suction port and the blow out port less externally visible in the operation stopped state, and to improve the aesthetic of the indoor unit of the air conditioner. In addition, the opening and closing panel, which is of a size on the order that closes the suction port and the blow out port, opens and closes the suction port by moving so that it is spaced apart from or proximate to the casing, and consequently the movement of the opening and closing panel corresponding to each operation mode is visually apparent. It is thereby possible with the indoor unit of the present air conditioner to improve the effect wherein the instruction to perform an operation mode can be visually perceived.

EFFECTS OF THE INVENTION

With the indoor unit of the air conditioner according to the first aspect of the invention, the suction port can be opened to an appropriate opening degree in accordance with the operation of the air conditioner, making it possible to ensure an amount of air suction appropriate to operation.

With the indoor unit of the air conditioner according to the second aspect of the invention, the control unit can modify the opening degree of the suction port in a plurality of steps, and it is consequently possible to open the suction port to an opening degree that is appropriate to the operation of the air conditioner. It is consequently possible to ensure an amount of air suction appropriate to operation.

With the indoor unit of the air conditioner according to the third aspect of the invention, it is possible to ensure an amount of suctioned air appropriate to the air volume produced by the ventilating apparatus.

With the indoor unit of the air conditioner according to the fourth aspect of the invention, the suction port is not opened to the same opening degree regardless of the operation mode, but rather the suction port can be opened to an opening degree appropriate to each operation mode, and it is consequently possible to perform appropriate operation in each of a plurality of operation modes.

With the indoor unit of the air conditioner according to the fifth aspect of the invention, the suction port is not opened to the same opening degree regardless of the operation mode, but rather the suction port can be opened to an opening degree appropriate to each operation mode, and it is consequently possible to perform appropriate operation in each of a plurality of operation modes.

With the indoor unit of the air conditioner according to the sixth aspect of the invention, it is possible to prevent operating noise and to prevent a reduction in air conditioning capacity in the second operation mode.

With the indoor unit of the air conditioner according to the seventh aspect of the invention, it is possible to reduce the pressure loss of the suctioned air in the third operation mode, as well as to suppress wind noise produced by the suctioned air.

With the indoor unit of the air conditioner according to the eighth aspect of the invention, the suction port is maximally opened, and it is consequently possible to further reduce the pressure loss of the suctioned air.

With the indoor unit of the air conditioner according to the ninth aspect of the invention, it is possible to ensure a greater air conditioning capacity in the fourth operation mode.

With the indoor unit of the air conditioner according to the tenth aspect of the invention, the suction port is maximally opened in the fourth operation mode, and it is therefore possible to suck in a greater amount of air.

With the indoor unit of the air conditioner according to the eleventh aspect of the invention, it is possible to make the suction port and the blow out port less externally visible in the operation stopped state, and to improve the aesthetics of the indoor unit of the air conditioner. In addition, it is possible to improve the effect wherein the instruction to perform an operation mode can be visually perceived.

DETAILED DESCRIPTION OF THE INVENTION

Figure 1:
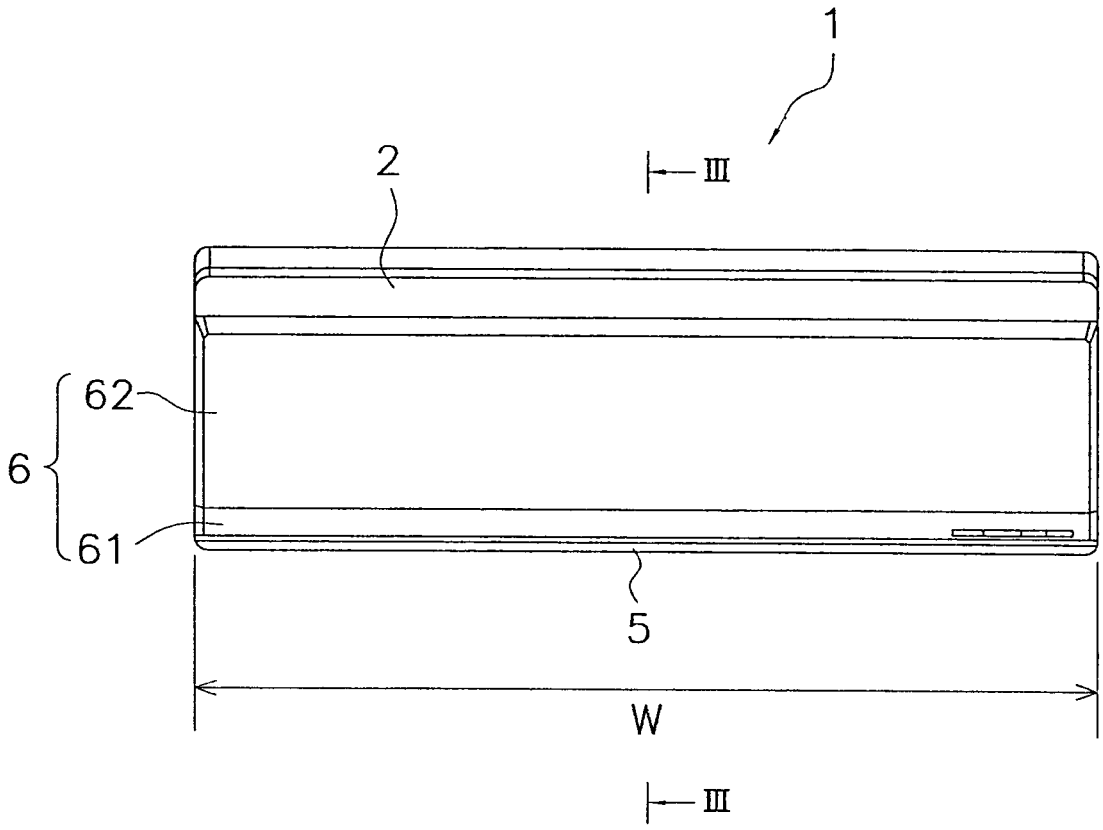
FIG. 1 is a front view of an indoor unit of an air conditioner.
Figure 2:
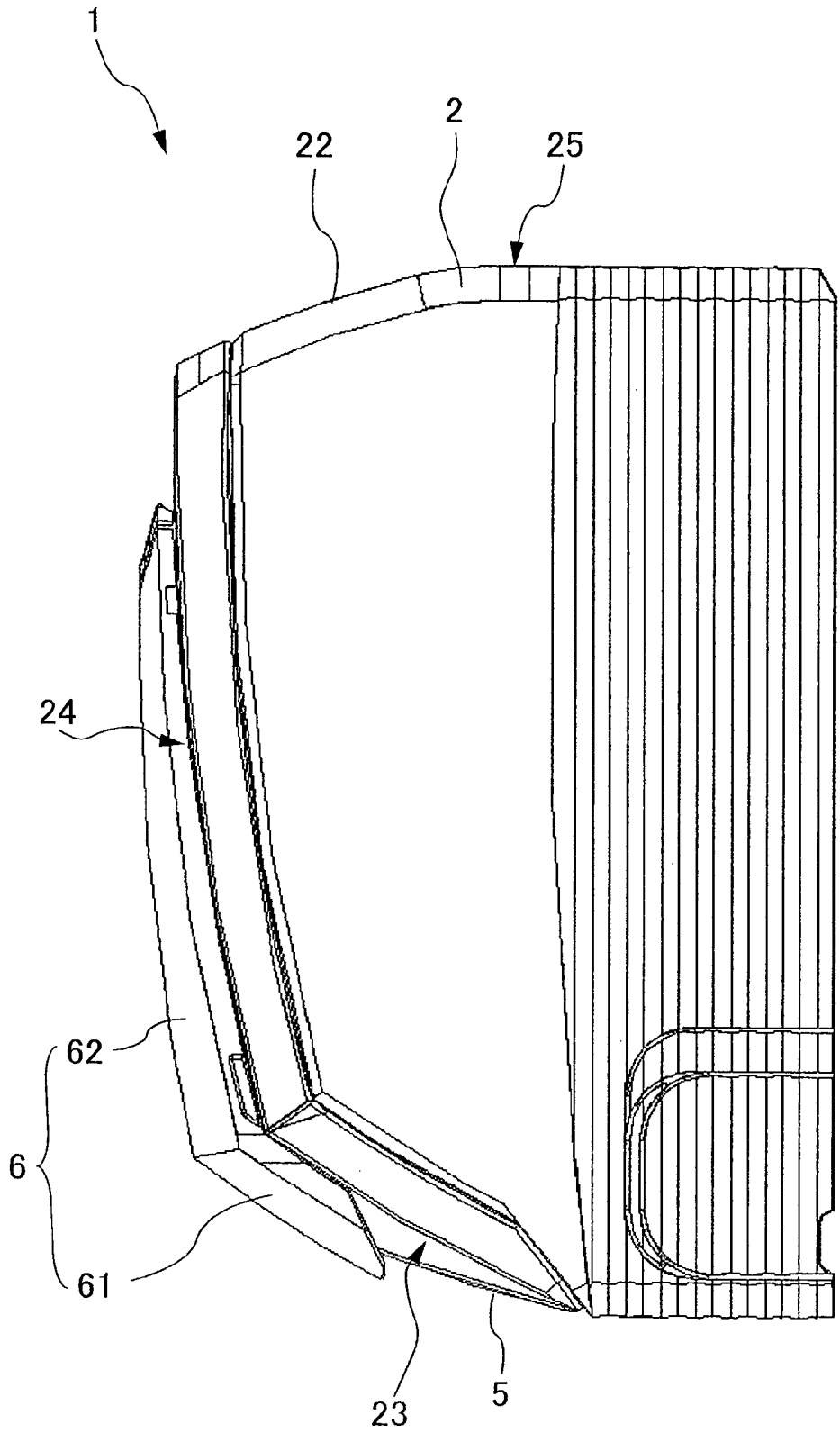
FIG. 2 is a side view of the indoor unit of the air conditioner.

FIG. 1 and FIG. 2 show an indoor unit 1 of an air conditioner according to one embodiment of the present invention. FIG. 1 is a front view of the indoor unit 1 of the air conditioner, and FIG. 2 is a side view thereof. The indoor unit 1 of the air conditioner is a wall mounted indoor unit that is attached to a wall surface of a room, and air conditions, e.g., heats and cools, the room. The indoor unit 1 of the air conditioner comprises an indoor unit casing 2 (casing), a ventilation fan 3 (ventilating apparatus; refer to FIG. 3), a fan motor 4 (refer to FIG. 7), a horizontal flap 5, a front panel 6, a moving mechanism 7 (refer to FIG. 6), a control unit 8 (refer to FIG. 7), and a remote control 9 (instructing apparatus; refer to FIG. 7).

<Indoor Unit Casing>

Figure 3:
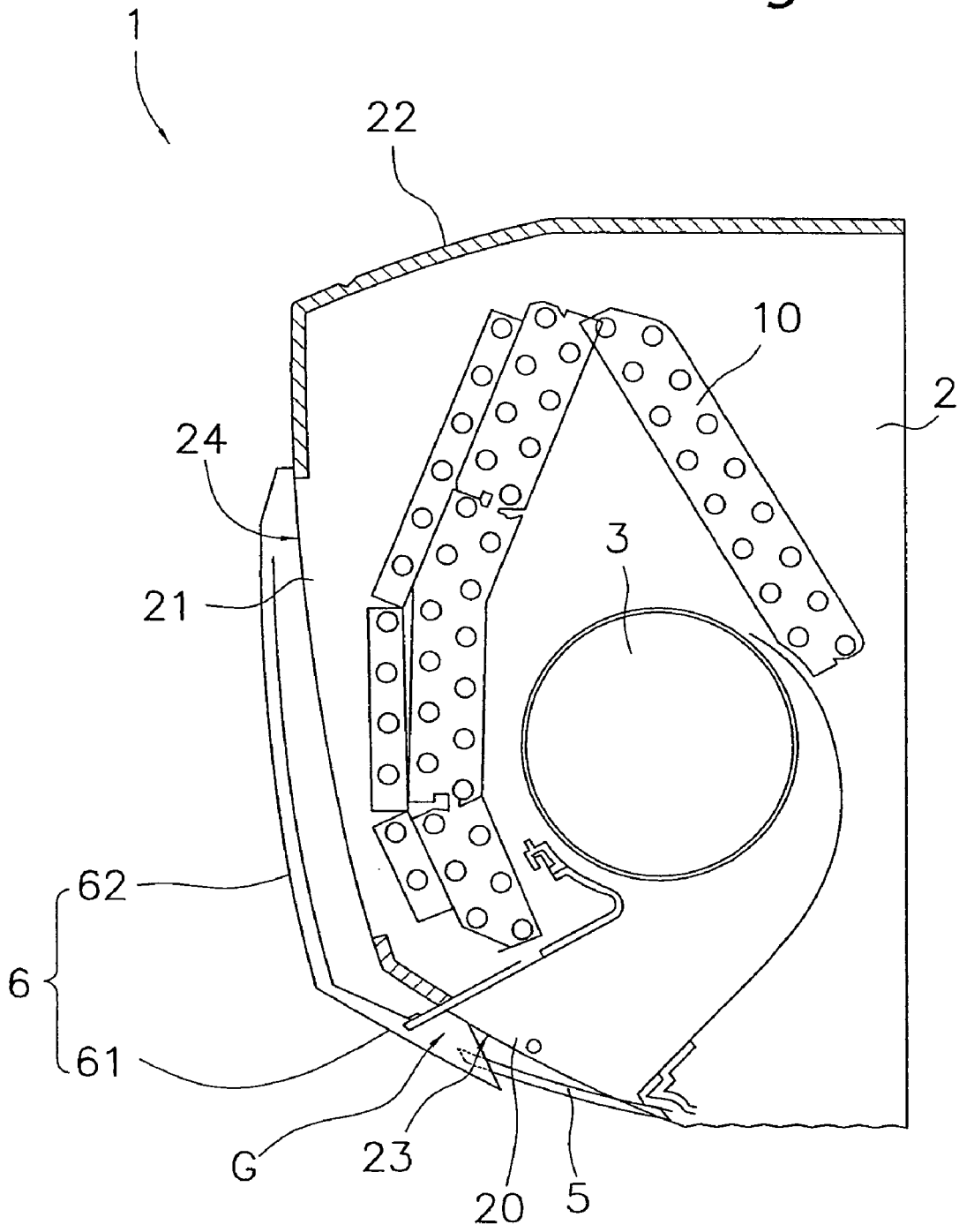
FIG. 3 is a cross sectional view taken along the III-III line in FIG. 1.

The indoor unit casing 2 has a rectangular shape that is long in the horizontal direction in the front view, as shown in FIG. 1, and houses, for example, an indoor heat exchanger 10 and the ventilation fan 3, as shown in FIG. 3, as well as the fan motor 4 and a control part (not shown). The front panel 6 is attached to a front surface of the indoor unit casing 2. The front panel 6 will be explained in detail later. The indoor unit casing 2 is provided with a blow out port 20, a first suction port 21 (suction port) and a second suction port 22. Furthermore, FIG. 3 is a side cross sectional view of the indoor unit 1.

The blow out port 20 is an opening through which air that is blown out into the room passes, and is provided to a first casing surface 23. As shown in FIG. 2, the first casing surface 23 constitutes a front side portion of a bottom surface of the indoor unit casing 2, and the blow out port 20 is provided to a lower part of the indoor unit casing 2. The first casing surface 23 is inclined so that its front end is positioned upward. The blow out port 20 has a shape that is long and narrow in a width W direction of the indoor unit casing 2 (the longitudinal direction of the indoor unit casing 2; refer to FIG. 1), and is provided with the horizontal flap 5.

The first suction port 21 shown in FIG. 3 is an opening through which the air that is taken into the interior of the indoor unit casing 2 passes, and is provided to a second casing surface 24. As shown in FIG. 2, the second casing surface 24 constitutes the front, i.e., the front surface, of the indoor unit casing 2, and the first suction port 21 is provided to the front of the indoor unit casing 2. The second casing surface 24 has a substantially flat shape that extends in the vertical direction, but is slightly inclined so that its upper end is positioned frontward. A lower end of the second casing surface 24 is continuous with the upper end of the first casing surface 23, and these surfaces form a prescribed angle. Namely, the first casing surface 23 and the second casing surface 24 form a bend at a relatively gentle angle of at least 90 and less than 180 degrees.

Figure 4:
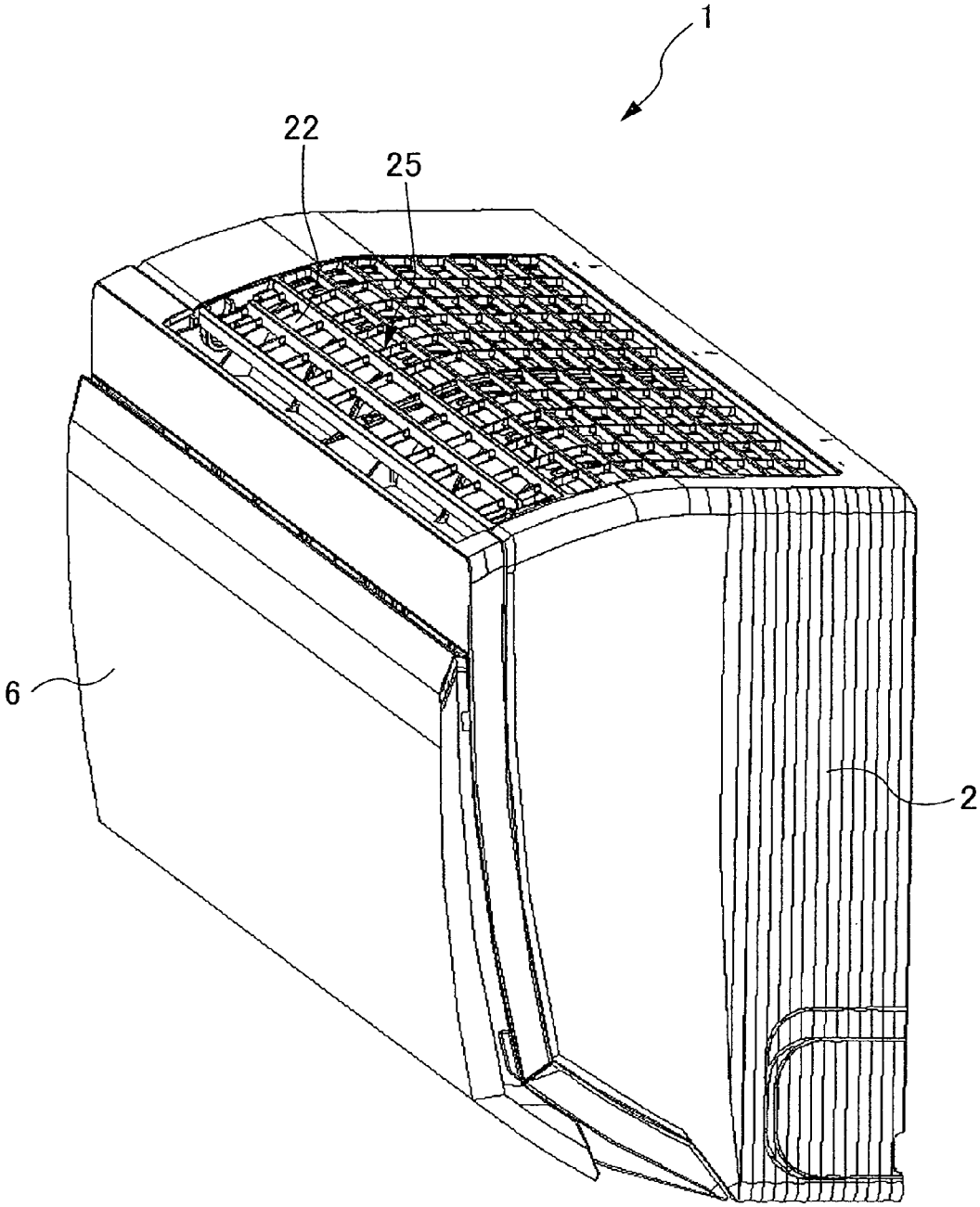
FIG. 4 is an external perspective view of the indoor unit of the air conditioner.

As shown in FIG. 4, the second suction port 22 is an opening through which the air that is taken into the indoor unit casing 2 passes, and is provided to a top surface 25 of the indoor unit casing 2. The second suction port 22 comprises a plurality of slits that extend in the width W direction of the indoor unit casing 2.

<Ventilation Fan and Fan Motor>

The ventilation fan 3 shown in FIG. 3 is a cross flow fan that has a long, thin cylindrical shape and is arranged so that its central axis is parallel to the horizontal direction. Blades are provided to a circumferential surface of the ventilation fan 3, and an air current is generated by the rotation of the ventilation fan 3 about its central axis. This air current is a flow of air that is taken in from the first suction port 21 and the second suction port 22, passes through the indoor heat exchanger 10, and is then blown out from the blow out port 20 to the room. The ventilation fan 3 is positioned at substantially the center of the indoor unit 1 in a side view.

The fan motor 4 (refer to FIG. 7) rotationally drives the ventilation fan 3 about its central axis. In a front view of the indoor unit 1, the fan motor 4 is disposed to the right side of the ventilation fan 3 and is concentric therewith. The control unit 8, which is discussed later, controls the rotational speed and the amount of ventilation of the ventilation fan 3.

<Horizontal Flap>

Figure 5:
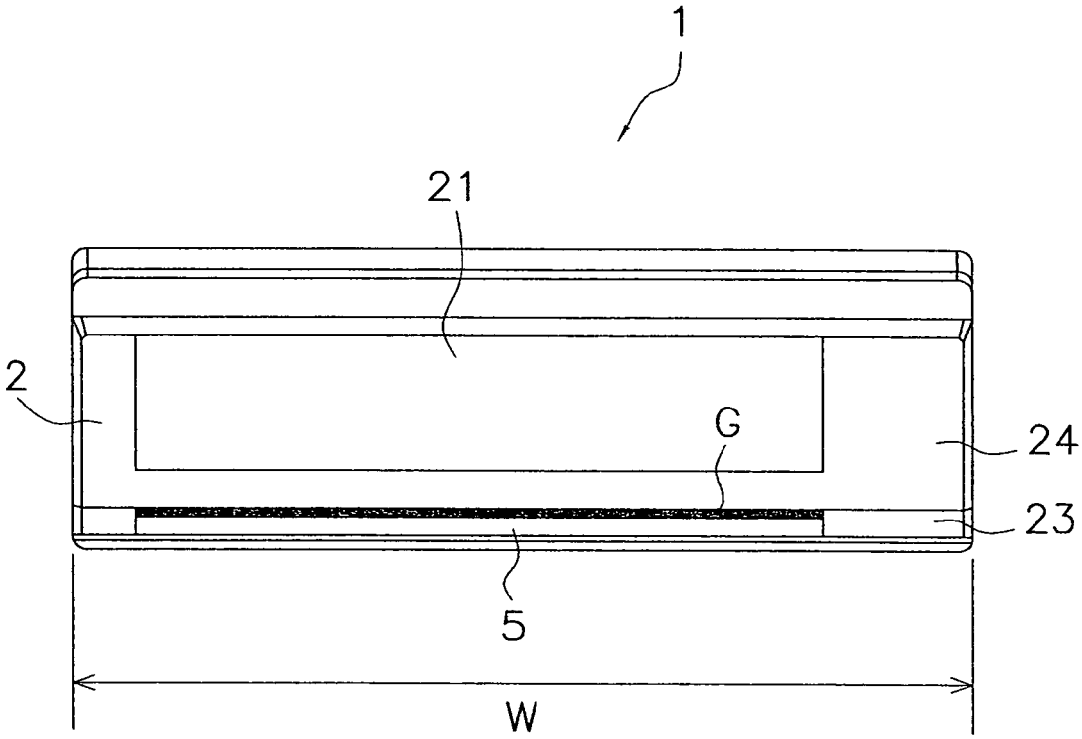
FIG. 5 is a front view of the indoor unit of the air conditioner, wherein its front panel has been removed.

The horizontal flap 5 is provided so that it can freely open and close the blow out port 20, and guides the air that is blown out therefrom. The horizontal flap 5 has a substantially rectangular shape that is thin and long in the width W direction of the indoor unit casing 2, and is provided to the blow out port 20 so that it is freely pivotable about an axis that is parallel to the width W direction of the indoor unit casing 2. A flap motor 50 (refer to FIG. 7) rotationally drives the horizontal flap 5. The horizontal flap 5 is shaped slightly smaller than the blow out port 20, and, as shown in FIG. 5, a gap G is provided between an upper end of the horizontal flap 5, which closes the blow out port 20, and the indoor unit casing 2. Providing the gap G makes it possible for the horizontal flap 5 to pivot in the blow out port 20 with little restriction. Furthermore, FIG. 5 is a front view of the indoor unit 1 that is in a state wherein the front panel 6 is removed.

<Front Panel>

The front panel 6 is provided to the front surface of the indoor unit casing 2, opens the first suction port 21 by moving so that it is spaced apart from the indoor unit casing 2, and closes the first suction port 21 by moving so that it is proximate to the indoor unit casing 2. In addition, in the closed state, the front panel 6 covers at least one part of the indoor unit casing 2 and at least one end of the horizontal flap 5, which closes the blow out port 20, thereby closing the first suction port 21 and the blow out port 20. Specifically, as shown in FIG. 2 and FIG. 3, the front panel 6 overlaps the outer side of a portion that extends from the vicinity of the upper end of the horizontal flap 5 that forms the long side to a midway part of the second casing surface 24. Accordingly, in the closed state, the front panel 6 covers the gap C, which was discussed above, between the blow out port 20 and the upper end of the horizontal flap 5. The front panel 6 has a shape that is bent along the bend formed by the second casing surface 24 and the first casing surface 23 of the indoor unit casing 2. The front panel 6 is shaped longer than the blow out port 20 in the width W direction of the indoor unit casing 2, and has a width W that is substantially the same as that of the indoor unit casing 2. In addition, as shown in FIG. 1, the front panel 6 does not have a seam that extends in the vertical direction in a front view. The front panel 6 comprises a first panel part 61 and a second panel part 62.

The first panel part 61 is a portion that covers the upper end of the horizontal flap 5 when the front panel 6 is in the closed state. The first panel part 61 constitutes the lower part of the front panel 6.

The second panel part 62 is a portion that covers the first suction port 21 when the front panel 6 is in the closed state. The second panel part 62 constitutes the upper part of the front panel 6.

The upper end of the first panel part 61 is continuous with the lower end of the second panel part 62, and when the front panel 6 is in the closed state, the first panel part 61 and the second panel part 62 are integrated at a prescribed angle so that they conform with the first casing surface 23 and the second casing surface 24.

Figure 10:
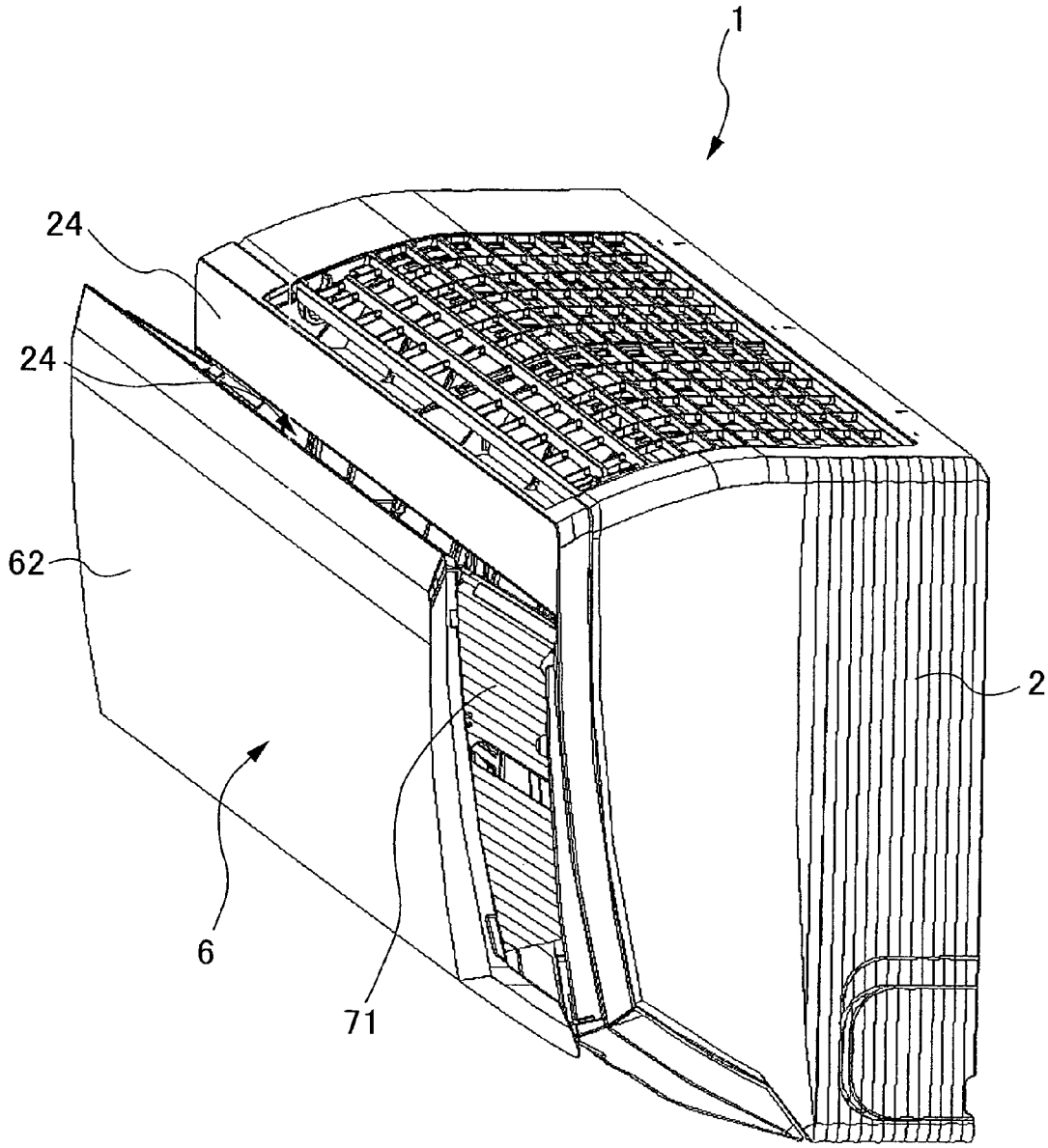
FIG. 10 is an external perspective view of the indoor unit of the air conditioner in a first open state.

Furthermore, both side ends of the front panel 6 are supported by first support members 71 (refer to FIG. 10). Two first support members 71 are provided to the indoor unit casing 2, one on each side end, and each one is movable frontward and rearward. The movement of these first support members 71 moves the front panel 6.

<Moving Mechanism>

Figure 6:
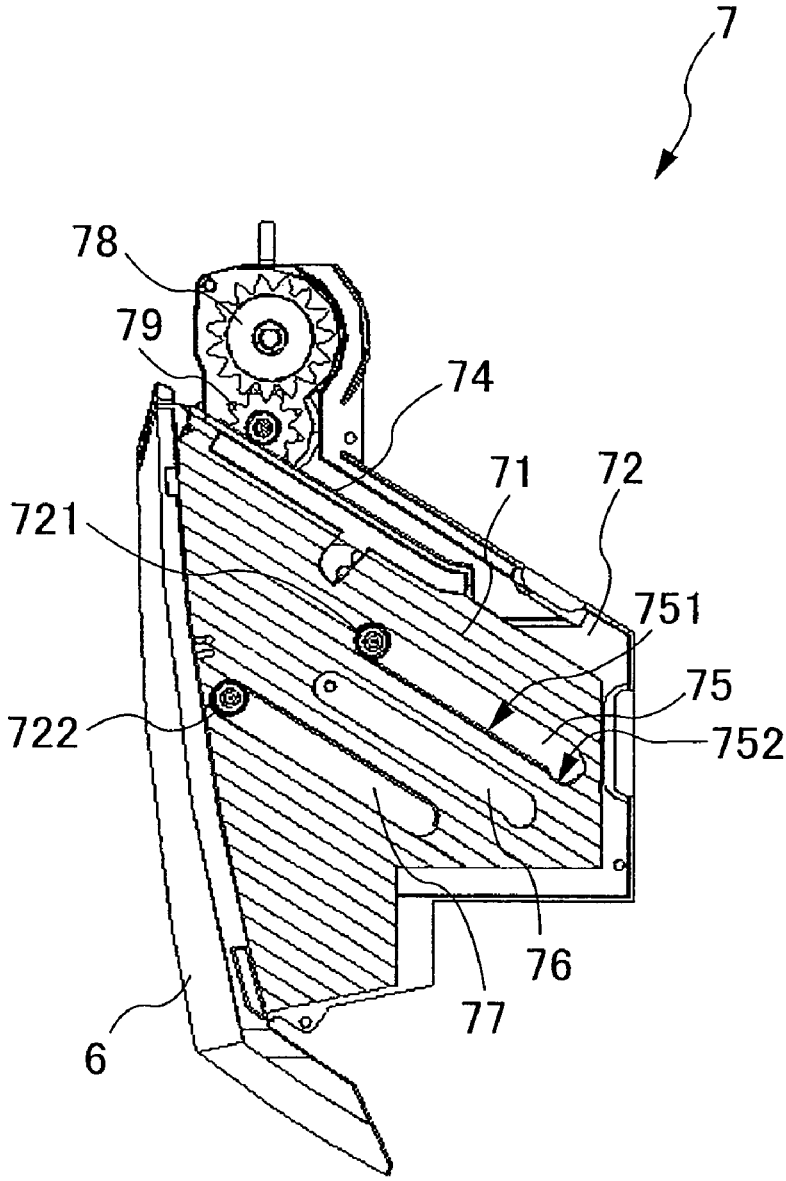
FIG. 6 shows the structure of a moving mechanism.

The moving mechanism 7 shown in FIG. 6 moves the front panel 6 so that the first suction port 21 opens to a desired opening degree. The moving mechanism 7 moves the front panel 6 to: the closed state, i.e., the state in FIG. 9(*a*), wherein the front panel 6 closes the first suction port 21; a first open state, i.e., the state in FIG. 9(*b*), wherein the front panel 6 moves frontward from the closed state and opens the first suction port 21; and a second open state, i.e., the state in FIG. 9(*c*), wherein the front panel 6 moves further frontward from the first open state and more widely opens the first suction port 21. If the front panel 6 transitions from the closed state to the first open state, then it performs parallel motion, and if the front panel 6 transitions from the first open state to the second open state, then it performs rotary motion. When the front panel 6 is in the first open state, the first suction port 21 is opened to the first opening degree. In addition, when the front panel 6 is in the second open state, the first suction port 21 is opened to the second opening degree, which is the maximum opening degree and is larger than the first opening degree. The moving mechanism 7 comprises the first support members 71, second support members 72, and a panel drive motor 73 (refer to FIG. 7).

Two first support members 71 are fixed substantially perpendicular to the side ends of the front panel 6, one on the left side end and one on the right side end, and are plate shaped members that support such. The upper end of each first support member 71 is inclined so that its front side is positioned upward and its rear side is positioned downward, and a rack gear 74, which meshes with a second pinion gear 79 (discussed later), is provided along the upper end of each first support member 71. In addition, a first slit part 75, a second slit part 76, and a third slit part 77 are provided at substantially the center portion of each first support member 71. The first slit part 75, the second slit part 76, and the third slit part 77 are slits that go through both sides of the corresponding first support member 71, and have a shape that is inclined so that their front sides are positioned upward and their rear sides are positioned downward, the same as the first support members 71. Each first slit part 75 comprises: a linear portion 751, which extends linearly upward from back to front; and a curved portion 752, which is curved downward so that it is slightly recessed, that is continuous with the rear end of the linear portion 751. The second slit part 76 and the third slit part 77 have the same shape as the first slit part 75. The second slit part 76 is positioned below the first slit part 75, and the third slit part 77 is positioned below the second slit part 76. In addition, the first slit part 75, the second slit part 76, and the third slit part 77 are arranged parallel to one another.

Each second support member 72 supports a first support member 71 so that it is capable of parallel motion and rotary motion, and two second support members 72 are attached to the inner sides of the indoor unit casing 2, one on the right side surface and one on the left side surface. The second support member 72 comprises a first pinion gear 78 and a second pinion gear 79, which mutually mesh. The first pinion gear 78 transmits the rotation of the panel drive motor 73 to the second pinion gear 79. The second pinion gear 79 transmits the rotation, which was transmitted from the first pinion gear 78, to the rack gear 74, which was discussed earlier. In addition, a first support flange 721 and a second support flange 722 are provided in the vicinity of the center part of the second support member 72. The first support flange 721 has a cylindrical shape that protrudes from the surface of the second support member 72, and is inserted into the first slit part 75 of the first support member 71. The first support flange 721 latches to the first slit part 75 and supports the first support member 71. The second support flange 722 also has a cylindrical shape that protrudes from the surface of the second support member 72, the same as the first support flange 721, and is inserted in the third slit part 77 of the first support member 71. The second support flange 722 latches to the third slit part 77 and supports the first support member 71. The first support flange 721 and the second support flange 722 slide with respect to the first slit part 75 and the third slit part 77 when the front panel 6 performs the opening and closing operations, thereby supporting the front panel 6 so that it moves frontward and rearward.

Figure 7:
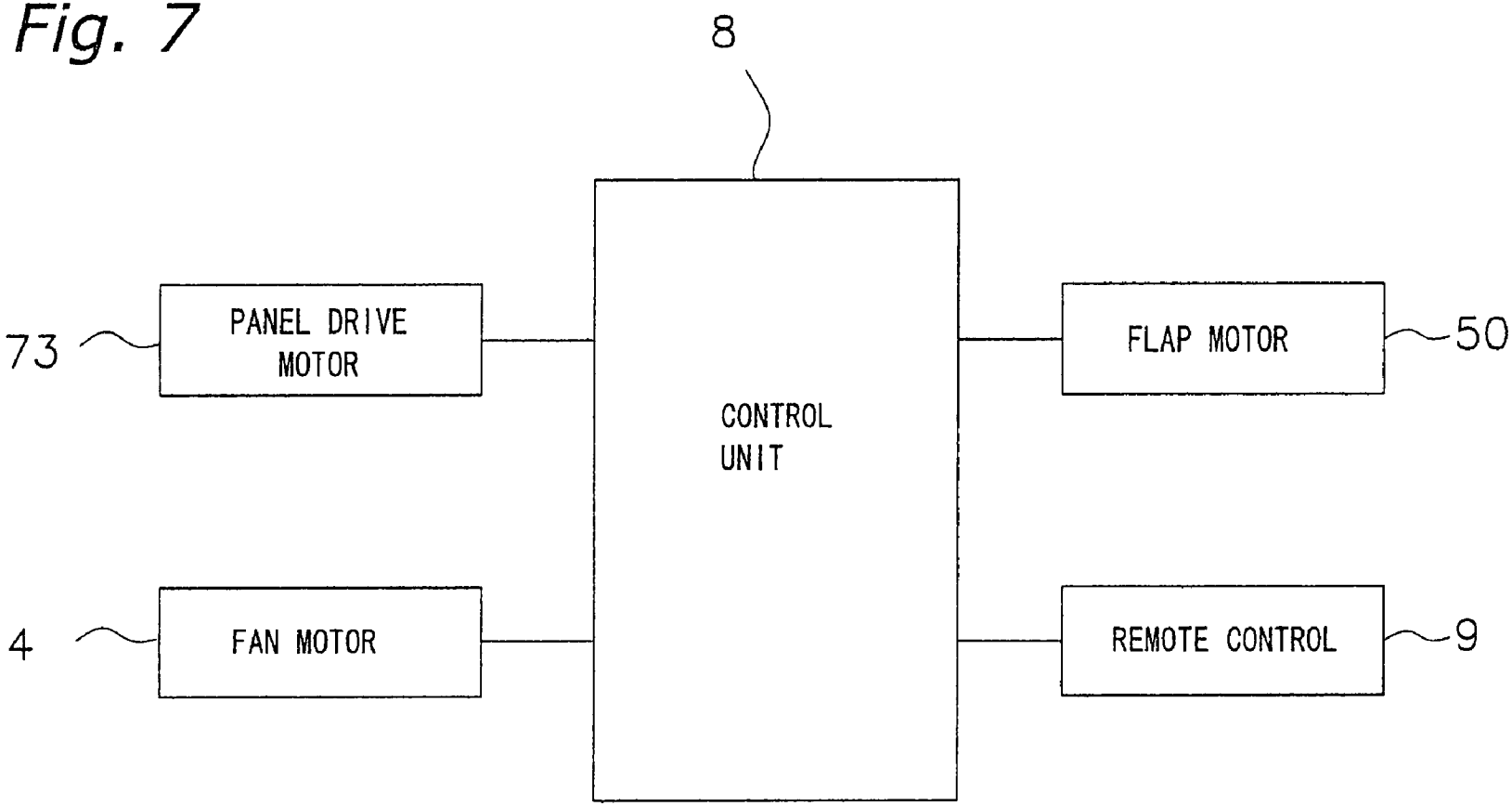
FIG. 7 is a control block diagram of the indoor unit of the air conditioner.

The panel drive motor 73 shown in FIG. 7 is controlled by the control unit 8 and is rotatably driven. The panel drive motor 73 transmits the rotation of the first pinion gears 78, and moves the first support members 71 with respect to the second support members 72.

<Control Unit>

The control unit 8 shown in FIG. 7 receives instructions from the remote control 9, which is discussed later, and controls, for example, the panel drive motor 73 of the moving mechanism 7, which was discussed above, the fan motor 4, and the flap motor 50. The operation modes for which the control unit 8 receives instructions include: the normal cooling and heating operations, a bedtime operation, and a power operation. Bedtime operation is an operation mode that maintains the quiet of a room by reducing operating noise, such as the drive noise of the fan motor 4 and the wind noise produced by the suctioning of air, more than during the normal cooling and heating operations. The power operation is an operation mode that rapidly cools or heats the room by increasing cooling or heating capacity more than during normal cooling and heating operations.

When the control unit 8 receives an instruction to perform normal cooling or heating operation, it controls the fan motor 4 to set the output of the ventilation fan 3 to a first air volume, and controls the panel drive motor 73 so as to cause the front panel 6 to transition to the first open state and thus open the first suction port 21 to a first opening degree.

In addition, when the control unit 8 receives an instruction to perform bedtime operation, it controls the fan motor 4 so as to set the output of the ventilation fan 3 to a second air volume, which is smaller than the first air volume, and controls the panel drive motor 73 so as to cause the front panel 6 to transition to the second open state and thus open the first suction port 21 to a second opening degree.

Furthermore, when the control unit 8 receives an instruction to perform power operation, it controls the fan motor 4 so as to set the output of the ventilation fan 3 to a third air volume, which is greater than the first air volume, and controls the panel drive motor 73 so as to set the front panel 6 to the second open state and thus open the first suction port 21 to the second opening degree.

Furthermore, when the control unit 8 receives an instruction to stop operation, it controls the fan motor 4 so as to stop the ventilation fan 3, controls the flap motor 50 so as to close the blow out port 20, and controls the panel drive motor 73 so as to set the front panel 6 to the closed state.

<Remote Control>

The remote control 9 is a device that allows the occupant to instruct the indoor unit 1 about the operation details, and the occupant can use, for example, a plurality of operation buttons provided to the remote control 9 to input those operation details. The remote control 9: receives the selection of the indoor unit 1 power supply on/off, and of the operation mode, such as normal heating operation, normal cooling operation, bedtime operation, and power operation; inputs, for example, a temperature setting and a timer setting; and sends a command signal to the control unit 8 by a communicating means using, for example, infrared communication.

<Opening and Closing Operations>

Figure 8:
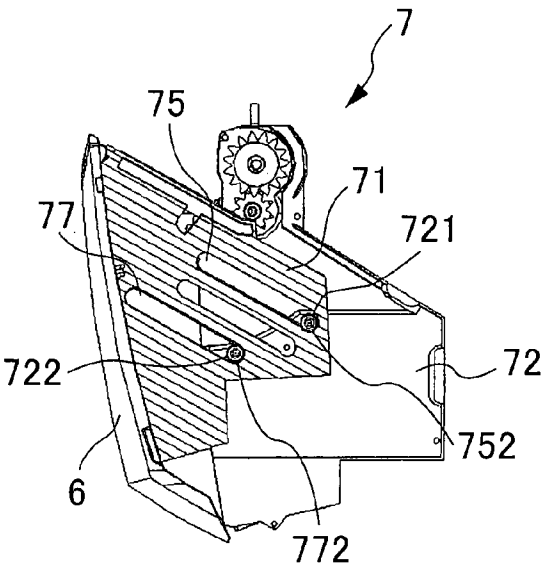
FIG. 8 shows the operation of the moving mechanism during opening and closing operations.
Figure 8:
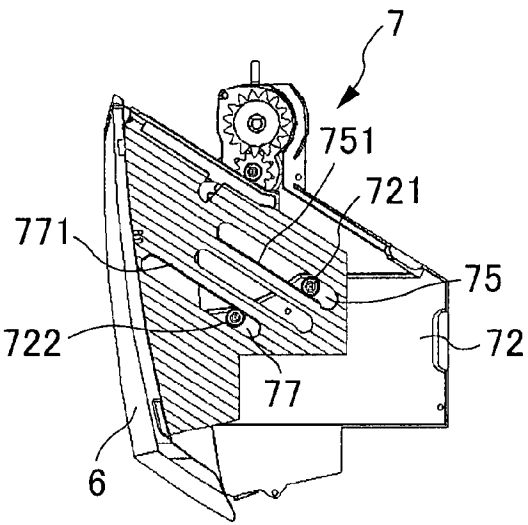
Figure 8:
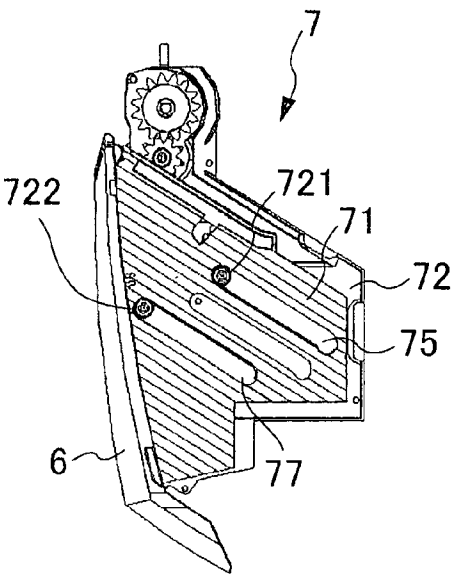
Figures 9A, 9B, 9C:
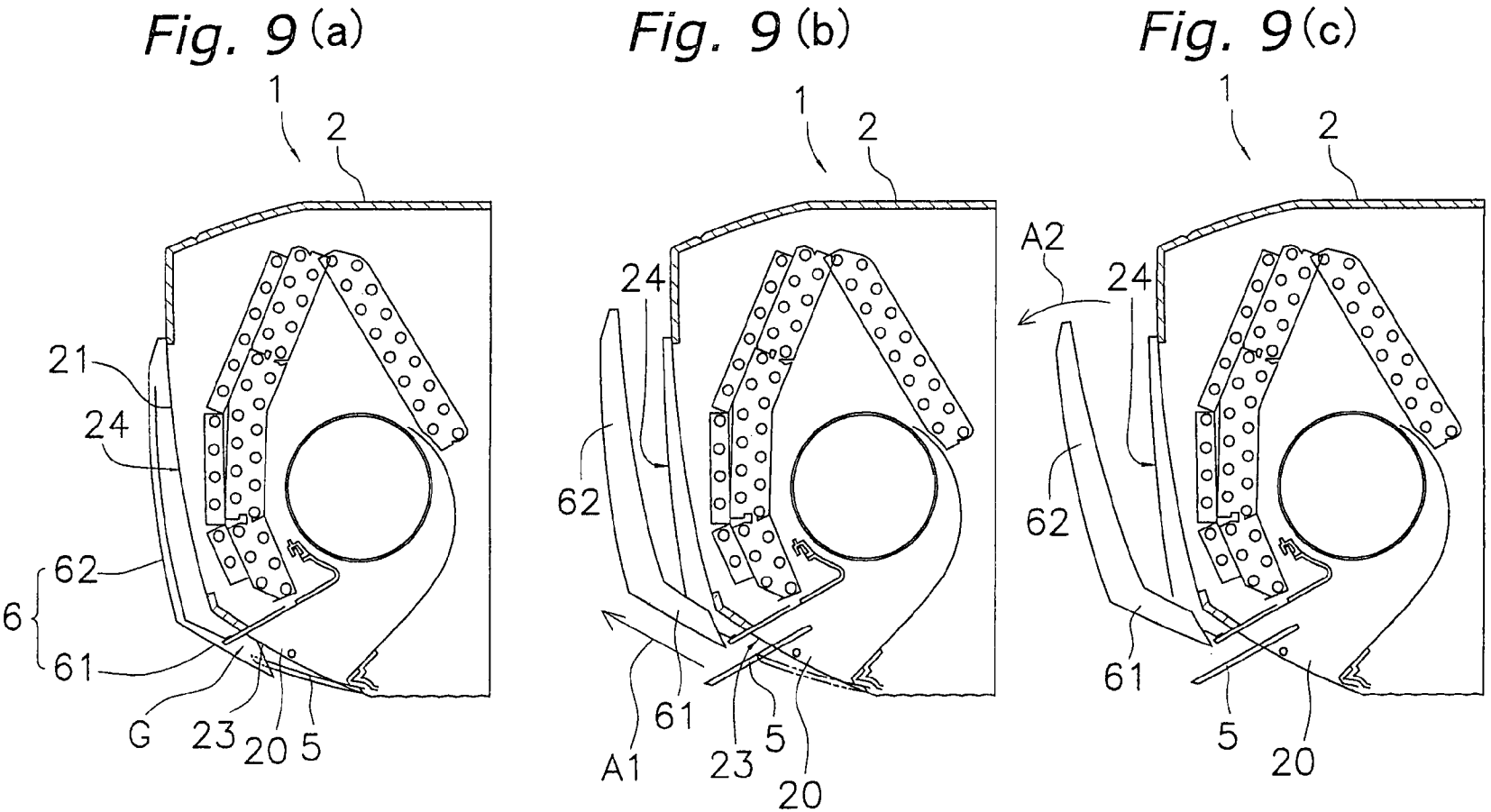
FIG. 9 shows the operation of the front panel during opening and closing operations.

The following explains the details of the opening and closing operations of the front panel 6, referencing FIG. 8 and FIG. 9.

When operation of the indoor unit 1 of the air conditioner is stopped, the blow out port 20 is closed by the horizontal flap 5, and the front panel 6 is in the closed state. In the closed state as shown in FIG. 8(*a*), the front end of the first slit part 75 of the first support member 71 is proximate to the first support flange 721, and the front end of the third slit part 77 of the first support member 71 is proximate to the second support flange 722; in addition, as shown in FIG. 9(*a*), the front panel 6 covers the first suction port 21 as well as the upper end of the horizontal flap 5. In this closed state, the first panel part 61 covers the upper end of the horizontal flap 5, the gap G between the upper end of the horizontal flap 5 and the blow out port 20, and the first casing surface 23 in the vicinity of the blow out port 20. In addition, the second panel part 62 covers the second casing surface 24. The front panel 6 has a bent shape, and its closed state is a state wherein it follows along and is proximate to the first casing surface 23 and the second casing surface 24. Thereby, when operation of the indoor unit 1 is stopped, the portion from the upper end of the horizontal flap 5 to the first suction port 21 is concealed from external view.

If the front panel 6 transitions from the closed state to the first open state, then, as shown in FIG. 8(*b*), the first support member 71 moves in a direction so that, the rear end of the linear portion 751 of the first slit part 75 is proximate to the first support flange 721, and the rear end of a linear portion 771 of the third slit part 77 is proximate to the second support flange 722. At this time, the linear portion 751 of the first slit part 75 slides with respect to the first support flange 721, and the linear portion 771 of the third slit part 77 slides with respect to the second support flange 722. Thereby, the first support member 71 performs parallel motion diagonally frontward and upward, and, as shown in FIG. 9(*b*), the front panel 6 performs parallel motion diagonally frontward and upward (refer to arrow A1). At this time, the first panel part 61 moves diagonally frontward and upward along the first casing surface 23, the second panel part 62 moves diagonally frontward and upward so that it is spaced apart from the second casing surface 24, and thereby the front panel 6 opens the blow out port 20 and the first suction port 21. At this time, the lower end of the first panel part 61 moves to a position beyond the upper end of the blow out port 20 so that it does not obstruct the blowing out of air from the blow out port 20, and the first panel part 61 closes up the lower part between the second panel part 62 and the second casing surface 24. Furthermore, the blow out port 20 opens by the pivoting of the horizontal flap 5, which closed the blow out port 20. In addition, in this state, the upper part of the space between the second panel part 62 and the second casing surface 24 is open, as shown in FIG. 10, and the air taken in from the first suction port 21 can pass therethrough. Furthermore, in the first open state, both side parts of the space between the second panel part 62 and the second casing surface 24 are closed up by the first support members 71, which form blind plates so that the interior of the indoor unit casing 2 is not externally visible through the first suction port 21.

Furthermore, if the front panel 6 transitions from the first open state to the second open state, then, as shown in FIG. 8(*c*), the first support member 71 moves so that the curved portion 752 of the first slit part 75 latches to the first support flange 721, and a curved portion 772 of the third slit part 77 latches to the second support flange 722. Thereby, the first support member 71 performs rotary motion, and, as shown in FIG. 9(*c*), the front panel 6 performs rotary motion so that its upper end falls frontward (refer to arrow A2). At this time, the lower end of the first panel part 61 remains positioned in the first open state, and the front panel 6 rotates about the lower end of the first panel part 61, and thereby the upper end of the second panel part 62 moves rotationally in the frontward direction. Thereby, the upper part of the space between the second panel part 62 and the second casing surface 24 opens further, and the first suction port 21 also opens further, thereby transitioning to the second opening degree.

Furthermore, if the front panel 6 transitions from the second open state to the first open state, then the front panel 6 moves rotationally in the direction reverse to that mentioned above. In addition, when operation of the indoor unit 1 is stopped, after the horizontal flap 5 has pivoted and closed the blow out port 20, the front panel 6 performs parallel motion in the direction reverse to that mentioned above, and the portion from the upper end of the horizontal flap 5 to the first suction port 21 is once again concealed from external view.

<Features>

(1)

With the indoor unit 1 of the present air conditioner, the portion from the upper end of the horizontal flap 5 to the first suction port 21 is concealed by the front panel 6 when operation is stopped. Consequently, the relatively large gap G for enabling the horizontal flap 5 to pivot becomes less externally visible. Thereby, with the indoor unit 1 of the present air conditioner, aesthetics are enhanced by, for example, the improvement of its interior design aspect.

In addition, if the front panel 6 of the type mentioned above is not provided, then it is necessary to reduce the gap G in order for such a gap G not to be exposed to the front; in this case, the movement of the horizontal flap 5 can be limited to the rotational direction. Accordingly, with the indoor unit 1 of the present air conditioner, the limitation on the movement of the horizontal flap 5 to the rotational direction is eased.

(2)

With the indoor unit 1 of the present air conditioner, in bedtime operation, the first suction port 21 is opened to the second opening degree and the air volume is reduced to the second air volume. Thereby, it is possible to reduce the rotational speed of the ventilation fan 3 as well as the operating noise. In addition, increasing the opening degree to the second opening degree reduces the pressure loss of the suctioned air. This makes it possible to reduce operating noise as well as to maintain the air conditioning capacity that was attained prior to changing the opening degree.

(3)

With the indoor unit 1 of the present air conditioner, in the power mode, the first suction port 21 is opened to the second opening degree and the air volume is increased to the third air volume. This makes it possible to increase air conditioning capacity. In addition, by making it possible to reduce the loss of air suction pressure, it is possible to output the air conditioning capacity needed for power operation by setting the rotational speed of the ventilation fan 3 and the frequency of the compressor lower than the case wherein power operation is performed at the first opening degree. It is thereby possible to prevent an increase in, for example, operating noise and power consumption.

In addition, during power operation, the front panel 6 transitions to the second open state wherein it is greatly pushed out in the frontward direction. Consequently, an effect is achieved wherein the performance of power operation visually appeals to, for example, the occupant.

(4)

With the indoor unit 1 of the present air conditioner, the front panel 6 has a bent shape. Furthermore, the front panel 6, which covers the blow out port 20 when operation is started, moves linearly and diagonally frontward and upward to a position where it opens the blow out port 20, thereby transitioning to a state wherein the blow out port 20 is open and the first panel part 61 closes up the lower end of the space between the second panel part 62 and the second casing surface 24. In addition, even when the front panel 6 transitions from the first open state to the second open state and thus further increases the opening degree, the front panel 6 moves rotationally about its lower end, and the first panel part 61 consequently maintains a state wherein it closes up the lower end of the space between the second panel part 62 and the second casing surface 24. Consequently, in the first open state and the second open state, it is possible to prevent the occurrence of a short circuit, wherein the air blown out from the blow out port 20 is sucked in once again from the first suction port 21 through the lower part of the space between the second panel part 62 and the second casing surface 24. Thereby, it is possible to prevent, for example, condensation and a reduction in the air conditioning capacity of the indoor unit due to a short circuit.

In addition, because a short circuit is prevented, the front panel 6 can be moved to a relatively large extent, which makes it possible to ensure a large area of the opening provided at the upper part of the space between the second panel part 62 and the second casing surface 24.

(5)

With the indoor unit 1 of the present air conditioner, the shapes of the slit parts 75, 77, wherein two types of shapes are combined as mentioned above, makes it possible to change the trajectory of the front panel 6 in two steps: linearly and arcuately. Consequently, there is no need to provide a complicated mechanism, and the opening degree of the front panel 6 can be adjusted by merely controlling the pulses of a single panel drive motor 73.

(6)

From the perspective of the aesthetics of the indoor unit 1 of the air conditioner, the closed state as discussed above has the best interior design aspect and aesthetics. Furthermore, the greater the opening degree of the first suction port 21, the more the outline of the indoor unit 1 of the air conditioner changes, thereby degrading its interior design aspect. Consequently, the second open state has the poorest aesthetics, and the first open state has better aesthetics than the second open state. Furthermore, with the indoor unit 1 of the present air conditioner, it is possible to select the state of the front panel 6 from among the closed state, the first open state, and the second open state by issuing an instruction via the remote control 9 to perform an operation mode. Consequently, the occupant and the like can also select the outline of the indoor unit 1 of the air conditioner based on aesthetics by selecting the operation mode.

Other Embodiments (1)

In bedtime operation in the abovementioned embodiment, the control unit 8 may control the fan motor 4 so as to set the output of the ventilation fan 3 to the first air volume, and may control the panel drive motor 73 so as to open the first suction port 21 to the second opening degree. When performing such control, the air volume from the ventilation fan 3 is the first air volume, which is the same as that in normal cooling and heating operations; however, by more widely opening the first suction port 21, the wind noise produced by the suctioning of air decreases, as does the operating noise.

(2)

With the abovementioned embodiment, the length of the lower end of the front panel 6 is short in order to achieve smooth opening and closing operations, and the vicinity of the lower end of the horizontal flap 5 is not covered by the front panel 6. However, when considering the enhancement of aesthetics, the front panel 6 may cover the entirety of the horizontal flap 5.

Conversely, from an aesthetics perspective, the front panel 6 in the closed state preferably covers as wide an area of the first suction port 21 and the blow out port 20 as possible; however, the front panel 6 is not necessarily limited to completely covering the entirety of the first suction port 21 and the blow out port 20, but should cover at least part of the first suction port 21 and the blow out port 20.

In addition, the closed state of the front panel 6 is a state wherein the first blow out port 20 is closed, but it is not necessarily limited to a state wherein the first blow out port 20 is completely sealed, and does not exclude the case wherein the first blow out port 20 is open to a slight opening degree.

(3)

In the abovementioned embodiment, the second opening degree is the maximum opening degree of the first suction port 21, but it may also be possible for the first suction port 21 to open to an even larger opening degree, instead of the second degree being the maximum opening degree. For example, the first suction port 21 may open more widely than the second opening degree during filter maintenance, another operation mode, or when removing the front panel 6. In addition, even if the second opening degree is the maximum opening degree, then it may also be possible to provide some play to the front panel 6 so that it can be manually opened more widely than the second opening degree.

(4)

The remote control 9 may issue instructions to perform other operation modes different from those in the abovementioned embodiment, and the indoor unit 1 of the air conditioner may be provided with operation modes that are selected from the perspective of aesthetics. For example, it may be possible to select, for example: a nighttime operation mode, which is selected if the occupant is asleep and is not concerned with the external appearance of the indoor unit 1; or an unattended operation mode, which ventilates the room and is selected if the occupant is absent from the room and is not concerned with the external appearance of the indoor unit 1. If such an operation mode is selected, the front panel 6 transitions to the second open state. Because this operation mode is one that is selected if, for example, the occupant is not concerned with the external appearance of the indoor unit 1, power consumption can be reduced by widely opening the first suction port 21 and by reducing the rotational speed of the fan motor 4 and the frequency of the compressor.

(5)

With the abovementioned embodiment, the front panel 6 can change from the closed state to two open states: the first open state and the second open state; however, the front panel 6 may be one that can change to three or more open states, and the first suction port 21 may open in three or more steps. Namely, the control unit 8 may modify the opening degree of the first suction port 21 to a desired opening degree from among a plurality of steps, and the present invention is not limited to the two steps in the abovementioned embodiment.

In addition, with the abovementioned embodiment, the first suction port 21 opens to the same second opening degree during power operation and bedtime operation, but may also open to different opening degrees in these operation modes.

Furthermore, with the abovementioned embodiment, the first suction port 21 opens to the same opening degree in a given operation mode, but the opening degree of the first suction port 21 may be adjusted to a different opening degree during the same operation mode. Thereby, it is possible to finely adjust the opening degree in accordance with operating conditions.

(6)

With the abovementioned embodiment, the front panel 6 moves in two modes: parallel motion and rotary motion; however, the present invention is not limited to these modes of motion. In addition, if the front panel 6 transitions from the closed state to the first open state, the trajectory of the front panel 6 does not necessarily need to be strictly linear, and may be somewhat curvilinear. Furthermore, when the front panel 6 transitions from the first open state to the second open state, the trajectory of the front panel 6 does not necessarily need to be strictly arcuate, and may be curvilinear instead.

(7)

With the abovementioned embodiment, the opening degree of the first suction port 21 is adjusted in accordance with the operation mode, which is selected by the user via the remote control 9, but may be adjusted in accordance with an operation mode that is automatically selected by the control unit 8, such as in automatic operation. For example, when starting up the indoor unit 1 of the air conditioner, the operation mode may be automatically modified after startup when a prescribed time has elapsed since startup and operation has stabilized, and the opening degree of the first suction port 21 may be modified in accordance with that modified operation mode.

(8)

With the abovementioned embodiment, the opening degree of the first suction port 21 is adjusted for each operation mode, but may be modified by a series of operations within a single operation mode. For example, in a given operation mode, the opening degree of the first suction port 21 may be modified in accordance with, for example, a change in temperature, a change in air volume, or the elapse of a time period.

INDUSTRIAL APPLICABILITY

The present invention achieves an effect wherein an amount of air suction appropriate to its operation can be ensured, and is therefore useful as an indoor unit of an air conditioner.

What is claimed is:

1. An indoor unit of an air conditioner, comprising:

a casing including a suction port;

a panel configured and arranged to open said suction port by moving so that said panel is spaced apart from said casing, and to close said suction port by moving so that said panel is proximate to said casing;

a fan motor;

a moving mechanism configured to move said panel to open said suction port to a desired degree of opening;

a panel drive motor configured and arranged to drive said moving mechanism to move said panel;

a control unit configured to execute an air conditioning operation in one operation mode selected from a plurality of operation modes, said control unit controlling said panel drive motor to control said moving mechanism to modify a degree of an opening of said suction port to said desired degree of opening corresponding to said one operation mode selected from said plurality of operation modes by controlling said moving mechanism, said control unit controlling said fan motor to modify air volume output; and a ventilating fan rotationally driven by said fan motor and controlled by said control unit via said fan motor such that when said control unit is instructed to perform a first operation mode among said plurality of operation modes, said control unit sets an output of said ventilating fan via said fan motor to a first air volume and opens said suction port to a first degree of opening by controlling said moving mechanism via said panel drive motor to cause said front panel to transition to a first open state and to stop and to remain in said first open state during said first operation mode, and when said control unit is instructed to perform a second operation mode among said plurality of operation modes, said control unit sets an output of said ventilating fan via said fan motor to a second air volume less than said first air volume, and opens said suction port to a second degree of opening greater than said first degree of opening by controlling said moving mechanism via said panel drive motor to cause said front panel to transition to a second open state greater than said first open state, and to stop and to remain in said second open state during said second operation mode.

2. The indoor unit as recited in claim 1, wherein said control unit modifies said degree of opening of said suction port in a plurality of steps by controlling said moving mechanism.

3. The indoor unit as recited in claim 1, further comprising an instruction apparatus configured to input a selection of an operation mode from said plurality of operation modes.

4. The indoor unit as recited in claim 1, wherein said suction port is maximally open at said second degree of opening.

5. The indoor unit as recited in claim 1, wherein said casing further includes a blow out port, said panel includes a first panel part that opens and closes said blow out port and a second panel part that is formed integrally with said first panel part and opens and closes said suction port, and said panel closes said suction port and said blow out port in an operation stopped state.

6. The indoor unit as recited in claim 2, further comprising an instruction apparatus configured to input a selection of an operation mode from said plurality of operation modes.

7. The indoor unit as recited in claim 6, wherein, when said control unit is instructed to perform a third operation mode among said plurality of operation modes, said control unit sets an output of said ventilating fan via said fan motor to said first air volume and opens said suction port to said second degree of opening, which is greater than said first degree of opening, by controlling said moving mechanism.

8. The indoor unit as recited in claim 7, wherein, when said control unit is instructed to perform a fourth operation mode among said plurality of operation modes, said control unit sets an output of said ventilating fan via said fan motor to a third air volume, which is greater than said first air volume, and opens said suction port to a third degree of opening, which is greater than said first degree of opening, by controlling said moving mechanism.

9. The indoor unit as recited in claim 8, wherein said suction port is maximally open at said third degree of opening.

10. The indoor unit as recited in claim 1, wherein said panel has two first support members arranged on opposite sides of said panel, said first support members fit inside said casing, and movement of said first support members causes said panel to open and to close, said casing has two second support members attached to an inner side thereof, and said second support members support said first support members, and said moving mechanism using uses said first and second support members to open and to close said panel.

11. The indoor unit as recited in claim 10, wherein said moving mechanism opens said panel diagonally upward and away from a casing surface of said casing on a panel side of said casing.

12. An indoor unit, comprising:

a casing including a suction port;

a panel configured and arranged to open said suction port by moving so that said panel is spaced apart from said casing, and to close said suction port by moving so that said panel is proximate to said casing;

a fan motor;

a moving mechanism configured to move said panel to open said suction port to a desired degree of opening;

a panel drive motor configured and arranged to drive said moving mechanism to move said panel;

a control unit configured to execute an air conditioning operation in one operation mode selected from a plurality of operation modes, said control unit controlling said panel drive motor to control said moving mechanism to modify a degree of an opening of said suction port to said desired degree of opening corresponding to said one operation mode selected from said plurality of operation modes by controlling said moving mechanism, said control unit controlling said fan motor to modify air volume output; and a ventilating fan driven by said fan motor and controlled by said control unit via said fan motor such that when said control unit is instructed to perform a first operation mode among said plurality of operation modes, said control unit sets an output of said ventilating fan via said fan motor to a first air volume and opens said suction port to a first degree of opening by controlling said moving mechanism via said panel drive motor to cause said front panel to transition to a first open state and to stop and to remain in said first open state during said first operation mode, and when said control unit is instructed to perform a second operation mode among said plurality of operation modes, said control unit sets an output of said ventilating fan via said fan motor to said first air volume and opens said suction port to a second degree of opening greater than said first degree of opening by controlling said moving mechanism via said panel drive motor to cause said front panel to transition to a second open state greater than said first open state and to stop and to remain in said second open state during said second operation mode.

13. The indoor unit as recited in claim 12, wherein said suction port is maximally open at said second degree of opening.

14. An indoor unit, comprising:

a casing including a suction port;

a panel configured and arranged to open said suction port by moving so that said panel is spaced apart from said casing, and to close said suction port by moving so that said panel is proximate to said casing, said panel having an upper end and a lower end;

a fan motor;

a moving mechanism configured to move said panel to open said suction port to a desired degree of opening from among a plurality of degrees of opening, the plurality of degrees of openings including a closed state with said panel being proximate to the casing, a first degree of opening with said panel being spaced apart from said casing, and said upper end of said panel being spaced farther apart from said casing than the lower end of said panel, a second degree of opening with said upper end of said panel being spaced farther apart from said casing than said lower end of said panel, and said upper end of said panel being spaced farther apart from said casing than in said first degree of opening;

a panel drive motor configured and arranged to drive said moving mechanism to move said panel;

a control unit configured to execute an air conditioning operation in one operation mode selected from a plurality of operation modes, said control unit controlling said panel drive motor to control said moving mechanism to modify a degree of an opening of said suction port to said desired degree of opening corresponding to said one operation mode selected from said plurality of operation modes by controlling said moving mechanism, said control unit controlling said fan motor to modify air volume output; and a ventilating fan rotationally driven by said fan motor and controlled by said control unit such that when said control unit is instructed to perform a first operation mode among said plurality of operation modes, said control unit sets an output of said ventilating fan via said fan motor to a first air volume and opens said suction port to a first degree of opening by controlling said moving mechanism via said panel drive motor to cause said front panel to transition to said first degree of opening and to stop and to remain in said first degree of opening during said first operation mode, and when said control unit is instructed to perform a second operation mode among said plurality of operation modes, said control unit sets an output of said ventilating fan via said fan motor to a third second air volume greater than said first air volume, and opens said suction port to a third said second degree of opening by controlling said moving mechanism via said panel drive motor to cause said front panel to transition to said second degree of opening and to stop and to remain in said second degree of opening during said second operation mode.

15. The indoor unit as recited in claim 14, wherein said suction port is maximally open at said second degree of opening.

* * * * *